US010806976B2

(12) United States Patent
James et al.

(10) Patent No.: US 10,806,976 B2
(45) **Date of Patent: *Oct. 20, 2020**

(54) GOLF CLUB

(71) Applicant: Taylor Made Golf Company, Inc., Carlsbad, CA (US)

(72) Inventors: Andrew James, Carlsbad, CA (US); Matthew David Johnson, San Diego, CA (US); Todd P. Beach, Encinitas, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/053,492

(22) Filed: Aug. 2, 2018

(65) Prior Publication Data

US 2019/0022479 A1 Jan. 24, 2019

Related U.S. Application Data

(63) Continuation of application No. 14/812,737, filed on Jul. 29, 2015, now Pat. No. 10,065,082.

(60) Provisional application No. 62/141,103, filed on Mar. 31, 2015.

(51) Int. Cl.

| | |
|---|---|
| ***A63B 53/00*** | (2015.01) |
| ***A63B 53/04*** | (2015.01) |
| ***A63B 60/52*** | (2015.01) |
| *A63B 53/02* | (2015.01) |

(52) U.S. Cl.

CPC ..... *A63B 53/0466* (2013.01); *A63B 60/52* (2015.10); *A63B 2053/023* (2013.01); *A63B 2053/0408* (2013.01); *A63B 2053/0416* (2013.01); *A63B 2053/0433* (2013.01); *A63B 2053/0491* (2013.01)

(58) Field of Classification Search

CPC ..... A63B 53/0566; A63B 60/52; A63B 2053/0416; A63B 2053/023; A63B 2053/0433; A63B 2053/0408; A63B 2053/0491

USPC ..... 143/327, 346, 349, 244, 245, 246, 247, 143/248, 342

See application file for complete search history.

(56) References Cited

U.S. PATENT DOCUMENTS

| | | | |
|---|---|---|---|
| 4,398,965 | A | 8/1983 | Campau |
| 4,438,931 | A | 3/1984 | Motomiya |
| 4,461,481 | A | 7/1984 | Kim |
| 4,511,145 | A | 4/1985 | Schmidt |

(Continued)

FOREIGN PATENT DOCUMENTS

| | | |
|---|---|---|
| CN | 2436182 | 6/2001 |
| CN | 201353407 | 12/2009 |

(Continued)

OTHER PUBLICATIONS

Adams Golf Speedline F11 Ti 14.5 degree fairway wood, 2pp. (www.bombsquadgolf.com, posted Oct. 18, 2010).

(Continued)

*Primary Examiner* — Vishu K Mendiratta

(74) *Attorney, Agent, or Firm* — Klarquist Sparkman LLP

(57) ABSTRACT

A golf club head includes a golf club body, a hosel connected to a heel portion of the golf club body, a face connected to a front of the golf club body, the face including an inner surface, an outer surface, and at least one boundary condition feature.

15 Claims, 8 Drawing Sheets

(56) References Cited

U.S. PATENT DOCUMENTS

| | | | | |
|---|---|---|---|---|
| 4,869,508 | A | 9/1989 | Miller | |
| D307,455 | S | 4/1990 | Boone | |
| D307,617 | S | 5/1990 | Boone | |
| 5,050,879 | A | 9/1991 | Sun et al. | |
| 5,133,553 | A | 7/1992 | Divnick | |
| D331,087 | S | 11/1992 | Fenton | |
| D339,397 | S | 9/1993 | Iinuma | |
| D340,753 | S | 10/1993 | Miesch | |
| D345,775 | S | 4/1994 | Poincenot et al. | |
| D349,142 | S | 7/1994 | Boone | |
| D350,581 | S | 9/1994 | Boone | |
| D350,583 | S | 9/1994 | Boone | |
| 5,419,556 | A | 5/1995 | Take | |
| D381,726 | S | 7/1997 | Sugo | |
| 5,681,227 | A | 10/1997 | Sayrizi | |
| D388,143 | S | 12/1997 | Huan-Chiang | |
| 5,709,615 | A | 1/1998 | Liang | |
| 5,718,641 | A | 2/1998 | Lin | |
| D398,353 | S | 9/1998 | Wooten | |
| 6,348,013 | B1 | 2/2002 | Kosmatka | |
| D464,387 | S | 10/2002 | Rollinson et al. | |
| D464,693 | S | 10/2002 | Rollinson et al. | |
| 6,558,273 | B2 | 5/2003 | Kobayashi et al. | |
| 6,605,007 | B1 | 8/2003 | Bissonnette | |
| 6,638,180 | B2 | 10/2003 | Tsurumaki | |
| 6,663,506 | B2 | 12/2003 | Nishimoto et al. | |
| D496,419 | S | 9/2004 | Lang et al. | |
| D498,277 | S | 11/2004 | Lang et al. | |
| 6,835,145 | B2 | 12/2004 | Tsurumaki | |
| D501,903 | S | 2/2005 | Tanaka | |
| 6,887,165 | B2 | 5/2005 | Tsurumaki | |
| D512,757 | S | 12/2005 | Cleveland et al. | |
| D518,123 | S | 3/2006 | Jones et al. | |
| D526,038 | S | 8/2006 | Kelley | |
| D532,848 | S | 11/2006 | Cleveland et al. | |
| D537,894 | S | 3/2007 | Cleveland et al. | |
| 7,273,423 | B2 | 9/2007 | Imamoto | |
| D552,702 | S | 10/2007 | Cameron | |
| D556,278 | S | 11/2007 | Mahaffey et al. | |
| 7,294,064 | B2 | 11/2007 | Tsurumaki et al. | |
| D563,497 | S | 3/2008 | Mahaffey et al. | |
| D565,685 | S | 4/2008 | Homma | |
| D574,456 | S | 8/2008 | Chen et al. | |
| D589,107 | S | 3/2009 | Oldknow | |
| 7,500,924 | B2 | 3/2009 | Yokota | |
| 7,530,901 | B2 | 5/2009 | Imamoto et al. | |
| 7,563,175 | B2 | 7/2009 | Nishitani et al. | |
| 7,572,193 | B2 | 8/2009 | Yokota | |
| 7,582,024 | B2 | 9/2009 | Shear | |
| D611,555 | S | 3/2010 | Oldknow | |
| D612,004 | S | 3/2010 | Oldknow | |
| D612,440 | S | 3/2010 | Oldknow | |
| D613,358 | S | 4/2010 | Kim et al. | |
| D622,336 | S | 8/2010 | Kohno | |
| D628,257 | S | 11/2010 | Albertsen et al. | |
| 7,857,711 | B2 * | 12/2010 | Shear | A63B 53/0466 473/329 |
| D630,278 | S | 1/2011 | Albertsen et al. | |
| D630,696 | S | 1/2011 | Albertsen et al. | |
| D631,119 | S | 1/2011 | Albertsen et al. | |
| D655,363 | S | 3/2012 | Vrska | |
| 8,277,337 | B2 | 10/2012 | Shimazaki | |
| D675,272 | S | 1/2013 | Greensmith et al. | |
| D686,679 | S | 7/2013 | Greensmith et al. | |
| D691,685 | S | 10/2013 | Cyrulik et al. | |
| D692,077 | S | 10/2013 | Greensmith et al. | |
| D696,366 | S | 12/2013 | Milo et al. | |
| D696,367 | S | 12/2013 | Taylor et al. | |
| D697,152 | S | 1/2014 | Harbert et al. | |
| D707,766 | S | 6/2014 | Wolfe et al. | |
| D708,278 | S | 7/2014 | Saliba et al. | |
| D708,279 | S | 7/2014 | Saliba et al. | |
| D737,913 | S | 9/2015 | Taylor et al. | |
| 10,065,082 | B2 * | 9/2018 | James | A63B 53/0466 |
| 2002/0055396 | A1 | 5/2002 | Nishimoto et al. | |
| 2002/0123394 | A1 | 9/2002 | Tsurumaki | |
| 2004/0176183 | A1 | 9/2004 | Tsurumaki | |
| 2004/0192463 | A1 | 9/2004 | Tsurumaki et al. | |
| 2007/0026961 | A1 | 2/2007 | Hou | |
| 2007/0049417 | A1 | 3/2007 | Shear | |
| 2010/0113176 | A1 | 5/2010 | Boyd et al. | |
| 2011/0151989 | A1 | 6/2011 | Golden et al. | |
| 2011/0151997 | A1 | 6/2011 | Shear | |
| 2011/0218053 | A1 | 9/2011 | Tang et al. | |
| 2011/0294599 | A1 | 12/2011 | Albertsen et al. | |
| 2012/0270676 | A1 | 10/2012 | Burnett et al. | |
| 2013/0331201 | A1 | 12/2013 | Wahl et al. | |
| 2014/0256461 | A1 | 9/2014 | Beach et al. | |

FOREIGN PATENT DOCUMENTS

| | | |
|---|---|---|
| JP | 4180778 | 6/1992 |
| JP | 2000014841 | 1/2000 |
| JP | 2001054595 | 2/2001 |
| JP | 2001170225 | 6/2001 |
| JP | 2001204856 | 7/2001 |
| JP | 2001346918 | 12/2001 |
| JP | 2002003969 | 1/2002 |
| JP | 2002017910 | 1/2002 |
| JP | 2002052099 | 2/2002 |
| JP | 2002248183 | 9/2002 |
| JP | 2002253706 | 9/2002 |
| JP | 2003038691 | 2/2003 |
| JP | 2003126311 | 5/2003 |
| JP | 2003226952 | 8/2003 |
| JP | 2004174224 | 6/2004 |
| JP | 2004183058 | 7/2004 |
| JP | 2004-351173 | 12/2004 |
| JP | 2005028170 | 2/2005 |
| JP | 04128970 | 7/2008 |
| JP | 2009000281 | 1/2009 |

OTHER PUBLICATIONS

Non-Final Office action, U.S. Appl. No. 29/416,410, 9pp. (dated Nov. 23, 2012).

Non-Final Office action, U.S. Appl. No. 29/416,411, 9pp. (dated Nov. 21, 2012).

* cited by examiner

GOLF CLUB

CROSS REFERENCE TO RELATED APPLICATION

This application is a continuation of U.S. patent application Ser. No. 14/812,737, which was filed on Jul. 29, 2015, which claims the benefit of U.S. Provisional Application No. 62/141,103, which was filed on Mar. 31, 2015, both of which are incorporated herein by reference in their entirety. This application references application for U.S. patent Ser. No. 14/145,761, entitled "GOLF CLUB," filed Dec. 31, 2014, which is incorporated by reference herein in its entirety and with specific reference to face slot technology. This application references U.S. Patent Application No. 62/027,692, filed on Jul. 22, 2014, and entitled "GOLF CLUB," which is incorporated by reference herein in its entirety. This application references application for U.S. patent Ser. No. 13/839,727, entitled "GOLF CLUB WITH COEFFICIENT OF RESTITUTION FEATURE," filed Mar. 15, 2013, which is incorporated by reference herein in its entirety and with specific reference to discussion of center of gravity location and the resulting effects on club performance. This application references U.S. Pat. No. 7,731,603, entitled "GOLF CLUB HEAD," filed Sep. 27, 2007, which is incorporated by reference herein in its entirety and with specific reference to discussion of moment of inertia. This application references U.S. Pat. No. 7,887,431, entitled "GOLF CLUB," filed Dec. 30, 2008, which is incorporated by reference herein in its entirety and with specific reference to discussion of adjustable loft and lie technology described therein and with reference to removable shaft technology and hosel sleeve connection systems. This application references application for U.S. patent Ser. No. 13/718,107, entitled "HIGH VOLUME AERODYNAMIC GOLF CLUB HEAD," filed Dec. 18, 2012, which is incorporated by reference herein in its entirety and with specific reference to discussion of aerodynamic golf club heads. This application references U.S. Pat. No. 7,874,936, entitled "COMPOSITE ARTICLES AND METHODS FOR MAKING THE SAME," filed Dec. 19, 2007, which is incorporated by reference herein in its entirety and with specific reference to discussion of composite face technology. This application references application for U.S. patent Ser. No. 14/144,105, entitled "GOLF CLUB," filed Dec. 30, 2013, which is incorporated by reference herein in its entirety and with specific reference to discussion of moment of inertia, center of gravity placement, and the effect of center of gravity placement on mechanics of golf club heads. This Application references application for U.S. patent Ser. No. 12/813,442, entitled "GOLF CLUB," filed Jun. 10, 2010, which is incorporated by reference herein in its entirety and with specific reference to discussion of variable face thickness. This Application references application for U.S. patent Ser. No. 12/791,025, entitled "HOLLOW GOLF CLUB HEAD," filed Jun. 1, 2010, and application for U.S. patent Ser. No. 13/338,197, entitled "FAIRWAY WOOD CENTER OF GRAVITY PROJECTION," filed Dec. 27, 2011, which are incorporated by reference herein in their entirety and with specific reference to slot technology and coefficient of restitution features. This Application references U.S. Pat. No. 6,773,360, entitled "GOLF CLUB HEAD HAVING A REMOVABLE WEIGHT," filed Nov. 8, 2002, which is incorporated by reference herein in its entirety and with specific reference to discussion of removable weight. This Application references U.S. Pat. No. 7,166,040, entitled "REMOVABLE WEIGHT AND KIT FOR GOLF CLUB HEAD," filed Feb. 23, 2004, which is a continuation-in-part of U.S. Pat. No. 6,773,360, entitled "GOLF CLUB HEAD HAVING A REMOVABLE WEIGHT," and which is incorporated by reference herein in its entirety and with specific reference to removable weight technology.

TECHNICAL FIELD

This disclosure relates to metal wood type golf club heads. More specifically, this disclosure relates to golf metal wood type golf club heads having features for increasing distance.

SUMMARY

A golf club head includes a golf club body, a hosel connected to a heel portion of the golf club body, a face connected to a front of the golf club body, the face including an inner surface, an outer surface, and at least one boundary condition feature.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Figure 1B:
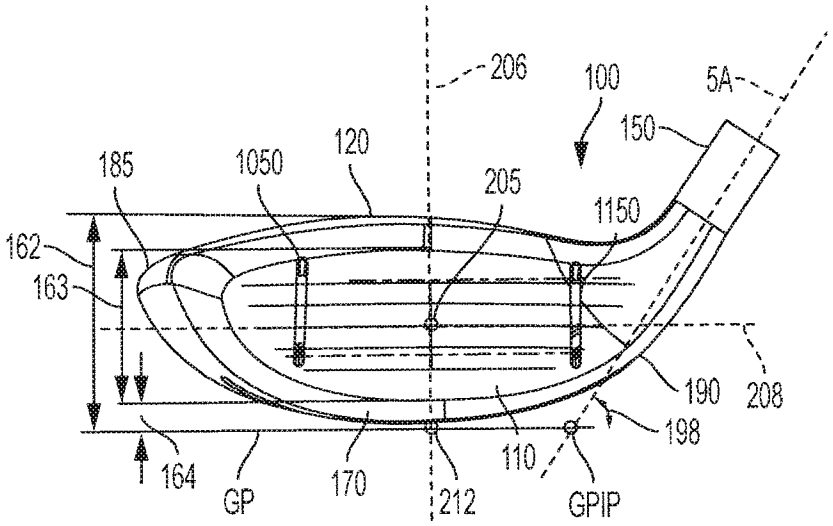
FIG. 1B is a face side view of the golf club head of FIG. 1A.

Disclosed is a golf club including a golf club head and associated methods, systems, devices, and various apparatus. It would be understood by one of skill in the art that the disclosed golf club is described in but a few exemplary embodiments among many. No particular terminology or description should be considered limiting on the disclosure or the scope of any claims issuing therefrom. For the sake of simplicity, standard unit abbreviations may be used, including but not limited to, "mm" for millimeters, "in." for inches, "lb." for pounds force, "mph" for miles per hour, and "rps" for revolutions per second, among others.

Portions of the following disclosure are coincident with application for U.S. patent Ser. No. 13/839,727, entitled "GOLF CLUB WITH COEFFICIENT OF RESTITUTION FEATURE," filed Mar. 15, 2013, which is incorporated by reference herein in its entirety, and with application for U.S. patent Ser. No. 14/145,761, entitled "GOLF CLUB," filed Dec. 31, 2014, which is incorporated by reference herein in its entirety. Although portions of these overlapping disclosures have been omitted from the current disclosure in the interest of efficiency, one of skill in the art would understand that the features and designs disclosed in the referenced application would apply to the descriptions of the technology of the current disclosure, and the full incorporation of application for U.S. patent Ser. No. 13/839,727 and application for U.S. patent Ser. No. 14/145,761 is beneficial for a complete understanding of the scope of the current disclosure. Additionally, claimed subject matter may include features or descriptions supplied in more full detail by the incorporation of application for U.S. patent Ser. No. 13/839,727 and application for U.S. patent Ser. No. 14/145,761, and claims covering content in the reference application are related to the disclosure of these applications.

In the game of golf, when a player increases his or her distance with a given club, the result nearly always provides an advantage to the player. While golf club design aims to maximize the ability of a player to hit a golf ball as far as possible, the United States Golf Association—a rulemaking body in the game of golf—has provided a set of rules to govern the game of golf. These rules are known as The Rules of Golf and are accompanied by various Decisions on The Rules of Golf. Many rules promulgated in The Rules of Golf affect play. Some of The Rules of Golf affect equipment, including rules designed to indicate when a club is or is not legal for play. Among the various rules are maximum and minimum limits for golf club head size, weight, dimensions, and various other features. For example, no golf club head may be larger than 460 cubic centimeters in volume. No golf club face may have a coefficient of restitution (COR) of greater than 0.830, wherein COR describes the efficiency of the golf club head's impact with a golf ball.

COR is a measure of collision efficiency. COR is the ratio of the velocity of separation to the velocity of approach. In this model, therefore, COR is determined using the following formula:

$$COR=(v_{club\text{-}post}-v_{ball\text{-}post})\div(v_{ball\text{-}pre}-v_{club\text{-}pre})$$

where, $v_{club\text{-}post}$ represents the velocity of the club after impact;

$v_{ball\text{-}post}$ represents the velocity of the ball after impact;

$v_{club\text{-}pre}$ represents the velocity of the club before impact (a value of zero for USGA COR conditions); and $v_{ball\text{-}pre}$ represents the velocity of the ball before impact.

Although the USGA specifies the limit for maximum COR, there is no specified region in which COR may be maximized. While multiple golf club heads have achieved the maximum 0.830 COR, the region in which such COR may be found has generally been limited—typically, in a region at a geometric center of the face of the golf club head or in a region of maximum COR that is in relatively small proximity thereto. Many golf club heads are designed to launch a golf ball as far as possible within The Rules of Golf when properly struck. However, even the greatest of professional golfers do not strike each and every shot perfectly. For the vast majority of golfers, perfectly struck golf shots are an exception if not a rarity.

There are several methods to address a particular golfer's inability to strike the shot purely. One method involves the use of increased Moment of Inertia (MOI). Increasing MOI prevents the loss of energy for strikes that do not impact the center of the face by reducing the ability of the golf club head to twist on off-center strikes. Particularly, most higher-MOI designs focus on moving weight to the perimeter of the golf club head, which often includes moving a center of gravity of the golf club head back in the golf club head, toward a trailing edge.

Another method involves use of variable face thickness (VFT) technology. With VFT, the face of the golf club head is not a constant thickness across its entirety, but rather varies. For example, as described in application for U.S. patent Ser. No. 12/813,442, entitled "GOLF CLUB," filed Jun. 10, 2010—which is incorporated herein by reference in its entirety—the thickness of the face varies in an arrangement with a dimension as measured from the center of the face. This allows the area of maximum COR to be increased as described in the reference.

While VFT is excellent technology, it can be difficult to implement in certain golf club designs. For example, in the design of fairway woods, the height of the face is often too small to implement a meaningful VFT design. Moreover, there are problems that VFT cannot solve. For example, edges of the golf club face tend to be more rigid than the center of the golf club face because the edges include connection features to the sole, crown, or skirt of the golf club head. Because the edges of the typical golf club face are integrated (either through a welded construction or as a single piece), a strike that is close to an edge of the face necessarily results in poor COR as it is proximate the rigid edge. It is common for a golfer to strike the golf ball at a location on the golf club head other than the center of the face. Typical locations may be high on the face or low on the face for many golfers. Both situations result in reduced COR. However, particularly with low face strikes, COR decreases very quickly. In various embodiments, the COR for strikes 5 mm below center face may be 0.020 to 0.035 difference. Further off-center strikes may result in greater COR differences.

To combat the negative effects of off-center strikes, certain designs have been implemented. For example, as described in application for U.S. patent Ser. No. 12/791,025, entitled "HOLLOW GOLF CLUB HEAD," filed Jun. 1, 2010, and application for U.S. patent Ser. No. 13/338,197, entitled "FAIRWAY WOOD CENTER OF GRAVITY PROJECTION," filed Dec. 27, 2011—both of which are incorporated by reference herein in their entirety—coefficient of restitution features located in various locations of the golf club head provide advantages. In particular, for strikes low on the face of the golf club head, the coefficient of restitution features allow greater flexibility than would typically be seen otherwise from a region low on the face of the golf club head. In general, the low point on the face of the golf club head is not flexible and, although not entirely rigid, does not experience the COR that may be seen in the geometric center of the face.

Although coefficient of restitution features allow for greater flexibility, they can often be cumbersome to implement. For example, in the designs above, the coefficient of restitution features are placed in the body of the golf club head but proximal to the face. While the close proximity enhances the effectiveness of the coefficient of restitution features, it creates challenges from a design perspective. Manufacturing the coefficient of restitution features may be difficult in some embodiments. Particularly with respect to application for U.S. patent Ser. No. 13/338,197, entitled "FAIRWAY WOOD CENTER OF GRAVITY PROJECTION," filed Dec. 27, 2011, the coefficient of restitution feature includes a sharp corner at the vertical extent of the coefficient of restitution feature that experiences extremely high stress under impact conditions. It may become difficult to manufacture such features without compromising their structural integrity in use. Further, the coefficient of restitution features necessarily extend into the golf club body, thereby occupying space within the golf club head. The size and location of the coefficient of restitution features may make mass relocation difficult in various designs, particularly when it is desirous to locate mass in the region of the coefficient of restitution feature.

In particular, one challenge with current coefficient of restitution feature designs is the ability to locate the center of gravity (CG) of the golf club head proximal to the face. As described in application for U.S. patent Ser. No. 13/839,727, entitled "GOLF CLUB WITH COEFFICIENT OF RESTITUTION FEATURE," filed Mar. 15, 2013 and application for U.S. patent Ser. No. 14/144,105, entitled "GOLF CLUB," filed Dec. 30, 2013, it has been discovered that it is desirous to locate the CG low in the golf club head. Such location of CG provides a low projection of CG onto the face of the golf club head, which results in reduced spin, leading to greater distance. In certain types of heads, it may still be the most desirable design to locate the CG of the golf club head as low as possible regardless of its location within the golf club head. However, for reasons explained in the references cited, it has unexpectedly been determined that a low and forward CG location may provide some benefits not seen in prior designs or in comparable designs without a low and forward CG.

For reference, within this disclosure, reference to a "fairway wood type golf club head" means any wood type golf club head intended to be used with or without a tee. For reference, "driver type golf club head" means any wood type golf club head intended to be used primarily with a tee. In general, fairway wood type golf club heads usually have lofts of greater than 14 degrees. In general, driver type golf club heads have lofts of 14 degrees or less, and, more usually, 12 degrees or less. In general, fairway wood type golf club heads have a length from leading edge to trailing edge of 73-97 mm. Various definitions distinguish a fairway wood type golf club head form a hybrid type golf club head, which tends to resemble a fairway wood type golf club head but be of smaller length from leading edge to trailing edge. In general, hybrid type golf club heads are 38-73 mm in length from leading edge to trailing edge. Hybrid type golf club heads may also be distinguished from fairway wood type golf club heads by weight, by lie angle, by volume, and/or by shaft length. Fairway wood type golf club heads of the current disclosure preferably are 16 degrees of loft. In various embodiments, fairway wood type golf club heads of the current disclosure may be from 15-19.5 degrees. In various embodiments, fairway wood type golf club heads of the current disclosure may be from 13-17 degrees. In various embodiments, fairway wood type golf club heads of the current disclosure may be from 13-19.5 degrees. In various embodiments, fairway wood type golf club heads of the current disclosure may be from 13-26 degrees. Additionally, most fairway wood type golf club heads are between 150 cc and 250 cc in volume as measured according to methods of the USGA. See U.S.G.A. "Procedure for Measuring the Club Head Size of Wood Clubs," Revision 1.0.0, Nov. 21, 2003, for the methodology to measure the volume of a wood-type golf club head. Exemplary fairway wood type golf club heads of the current disclosure may be between 180 cc and 240 cc. In various embodiments, fairway wood type golf club heads of the current disclosure are between 200 cc and 220 cc. Driver type golf club heads of the current disclosure preferably are 12 degrees or less of loft in various embodiments. Driver type golf club heads of the current disclosure may be 10.5 degrees or less in various embodiments. Driver type golf club heads of the current disclosure may be between 9 degrees and 14 degrees of loft in various embodiments. In various embodiments, driver type golf club heads may be as much as 16 degrees of loft. Additionally, most driver-type golf club heads are over 375 cc in volume. Exemplary driver-type golf club heads of the current disclosure may be over 425 cc in volume. In some embodiments, driver-type golf club heads of the current disclosure are between 440 cc and 460 cc in volume. In some embodiments, driver-type golf club heads of the current disclosure are between 430 cc and 470 cc in volume.

One embodiment of a golf club head 100 is disclosed and described with reference to FIGS. 1A-1C. As seen in FIG. 1A, the golf club head 100 includes a face 110, a crown 120, a sole 130, a skirt 140, and a hosel 150. Major portions of the golf club head 100 not including the face 110 are considered to be the golf club body for the purposes of this disclosure. A boundary condition feature (BCF) 300 is seen in the sole 130 of the golf club head 100. In various embodiments, the boundary condition feature 300 may be referenced as a "coefficient of restitution feature" (CORF). BCFs and CORFs are disclosed in further detail with reference to application for U.S. patent Ser. No. 13/839,727 and application for U.S. patent Ser. No. 14/145,761, both incorporated by reference herein in their entirety. One of skill in the art would understand that such BCFs and CORFs may be readily incorporated into the design of golf club head 100 without substantially deviating from the scope of the current disclosure. In various embodiments, CORFs and BCFs such as BCF 300 may be omitted. In various embodiments, the various different CORFs and BCFs may be included in various forms, shapes, sizes, and compositions. In various embodiments, modifications to BCF 300 may be included and would be understood by one of skill in the art to be intended to be included within the scope of the current disclosure.

A three dimensional reference coordinate system 200 is shown. An origin 205 of the coordinate system 200 is located at the geometric center of the face (CF) of the golf club head 100. See U.S.G.A. "Procedure for Measuring the Flexibility of a Golf Clubhead," Revision 2.0, Mar. 25, 2005, for the methodology to measure the geometric center of the striking face of a golf club. The coordinate system 200 includes a z-axis 206, a y-axis 207, and an x-axis 208 (shown in FIG. 1B). Each axis 206,207,208 is orthogonal to each other axis 206,207,208. The golf club head 100 includes a leading edge 170 and a trailing edge 180. For the purposes of this disclosure, the leading edge 170 is defined by a curve, the curve being defined by a series of forwardmost points, each forwardmost point being defined as the point on the golf club head 100 that is most forward as measured parallel to the y-axis 207 for any cross-section taken parallel to the plane formed by the y-axis 207 and the z-axis 206. The face 110 may include grooves or score lines in various embodiments. In various embodiments, the leading edge 170 may also be the edge at which the curvature of the particular section of the golf club head departs substantially from the roll and bulge radii.

Figure 1A:
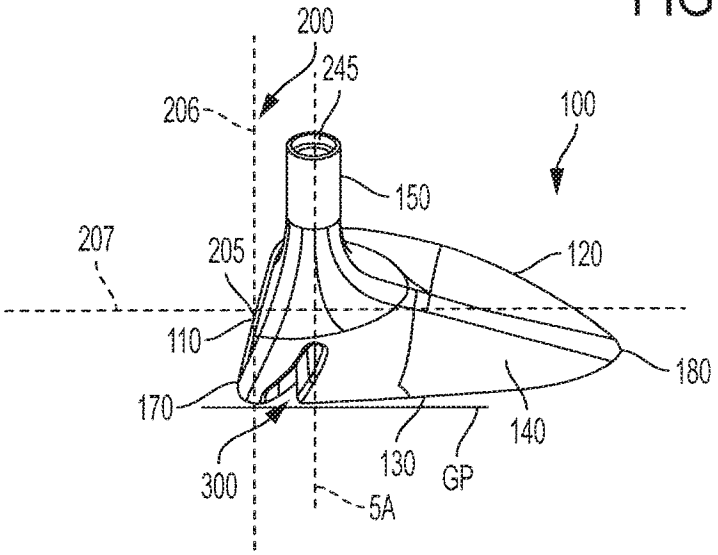
FIG. 1A is a heel side view of a golf club head in accord with one embodiment of the current disclosure.

As seen with reference to FIG. 1B, the x-axis 208 is parallel to a ground plane (GP) onto which the golf club head 100 may be properly soled—arranged so that the sole 130 is in contact with the GP. The y-axis 207 is also parallel to the GP and is orthogonal to the x-axis 208. The z-axis 206 is orthogonal to the x-axis 208, the y-axis 207, and the GP. The golf club head 100 includes a toe 185 and a heel 190.

The golf club head 100 includes a shaft axis (SA) defined along an axis of the hosel 150. When assembled as a golf club, the golf club head 100 is connected to a golf club shaft (not shown). Typically, the golf club shaft is inserted into a shaft bore 245 defined in the hosel 150. In various embodiments, a sleeve attachment may be included as disclosed in various references (incorporated by reference herein) to provide adjustable loft, lie, and face angle by varying connection of the SA with an axis of the hosel. The arrangement of the SA with respect to the golf club head 100 can define how the golf club head 100 is used. The SA is aligned at an angle 198 with respect to the GP. The angle 198 is known in the art as the lie angle (LA) of the golf club head 100. A ground plane intersection point (GPIP) of the SA and the GP is shown for reference. In various embodiments, the GPIP may be used a point of reference from which features of the golf club head 100 may be measured or referenced. As shown with reference to FIG. 1A, the SA is located away from the origin 205 such that the SA does not directly intersect the origin or any of the axes 206,207,208 in the current embodiment. In various embodiments, the SA may be arranged to intersect at least one axis 206,207,208 and/or the origin 205. A z-axis ground plane intersection point 212 can be seen as the point that the z-axis intersects the GP.

As seen with reference to FIG. 1A, the BCF 300 is shown defined in the sole 130 of the golf club head 100. A modular weight port may be included in the sole 130 for placement of removable weights. Various embodiments and systems of removable weights and their associated methods and apparatus are described in greater detail with reference to U.S. Pat. No. 6,773,360, entitled "GOLF CLUB HEAD HAVING A REMOVABLE WEIGHT," filed Nov. 8, 2002, and U.S. Pat. No. 7,166,040, entitled "REMOVABLE WEIGHT AND KIT FOR GOLF CLUB HEAD," filed Feb. 23, 2004, which are incorporated by reference herein in their entirety. The top view seen in FIG. 1C shows another view of the golf club head 100. The shaft bore 245 can be seen defined in the hosel 150.

Figure 1C:
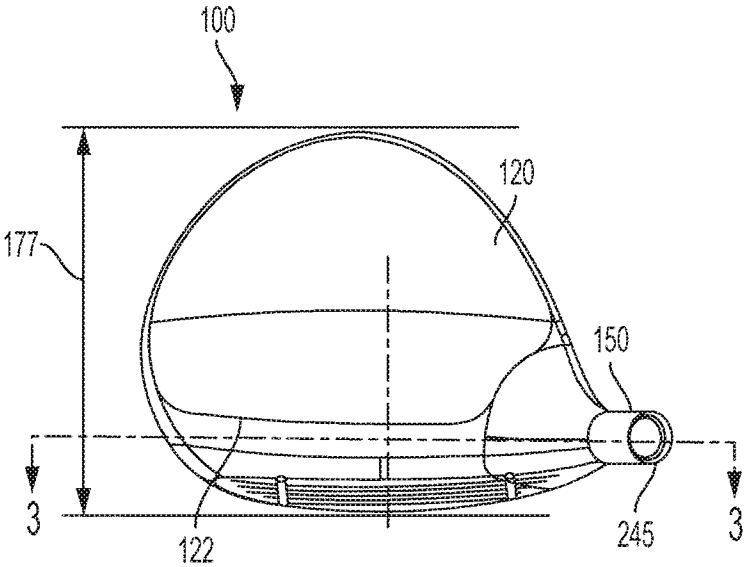
FIG. 1C is a top view of the golf club head of FIG. 1A.

With reference to FIGS. 1A-1C, a crown height 162 is shown and measured as the height from the GP to the highest point of the crown 120 as measured parallel to the z-axis 206. In the current embodiment, the crown height 162 is about 36 mm. In various embodiments, the crown height 162 may be 34-40 mm. In various embodiments, the crown height may be 32-44 mm. In various embodiments, the crown height may be 30-50 mm. The golf club head 100 also has an effective face height 163 that is a height of the face 110 as measured parallel to the z-axis 206. The effective face height 163 measures from a highest point on the face 110 to a lowest point on the face 110 proximate the leading edge 170. A transition exists between the crown 120 and the face 110 such that the highest point on the face 110 may be slightly variant from one embodiment to another. In the current embodiment, the highest point on the face 110 and the lowest point on the face 110 are points at which the curvature of the face 110 deviates substantially from a roll radius. In some embodiments, the deviation characterizing such point may be a 10% change in the radius of curvature. In the current embodiment, the effective face height 163 is about 27.5 mm. In various embodiments, the effective face height 163 may be 2-7 mm less than the crown height 162. In various embodiments, the effective face height 163 may be 2-12 mm less than the crown height 162. An effective face position height 164 is a height from the GP to the lowest point on the face 110 as measured in the direction of the z-axis 206. In the current embodiment, the effective face position height 164 is about 4 mm. In various embodiments, the effective face position height 164 may be 2-6 mm. In various embodiments, the effect face position height 164 may be 0-10 mm. A length 177 of the golf club head 177 as measured in the direction of the y-axis 207 is seen as well with reference to FIG. 1A. In the current embodiment, the length 177 is about 85 mm. In various embodiments, the length 177 may be 80-90 mm. In various embodiments, the length 177 may be 73-97 mm. The distance 177 is a measurement of the length from the leading edge 170 to the trailing edge 180. The distance 177 may be dependent on the loft of the golf club head in various embodiments. In one embodiment, the loft of the golf club head is about 15 degrees and the distance 177 is about 91.6 mm. In one embodiment, the loft of the golf club head is about 18 degrees and the distance 177 is about 87.4 mm. In one embodiment, the loft of the golf club head is about 21 degrees and the distance 177 is about 86.8 mm. In various embodiments, a composite crown plate 122 may be included. In various embodiments, additional crown features such as composites may be omitted.

With returning reference to FIG. 1B, the face 110 includes a pair of face-located boundary condition features 1050, 1150. A toe-located BCF 1050 in the current embodiment is a thru-slot extending from an outer surface of the face 110 to an inner surface of the face 110. A heel-located BCF 1150 in the current embodiment is a thru-slot extending from an outer surface of the face 110 to an inner surface of the face 110. As such, each of the BCFs 1050, 1150 of the current disclosure are thru-slots in the face 110 located in locations proximate the boundaries of the face 110. In the current disclosure, the BCFs 1050, 1150 are arrange such that the extent of each BCF 1050,1150 is elongated in a direction parallel to the z-axis. It would be understood by one of ordinary skill in the art that various embodiments of BCFs may be utilized, including channels, weakened regions, detached portions, thinned regions, and various other arrangements, including those disclosed for other clubhead regions in the disclosures of application for U.S. patent Ser. No. 13/338,197, entitled "FAIRWAY WOOD CENTER OF GRAVITY PROJECTION," filed Dec. 27, 2011, application for U.S. patent Ser. No. 12/791,025, entitled "HOLLOW GOLF CLUB HEAD," filed Jun. 1, 2010, application for U.S. patent Ser. No. 13/839,727, entitled "GOLF CLUB WITH COEFFICIENT OF RESTITUTION FEATURE," filed Mar. 15, 2013, and application for U.S. patent Ser. No. 14/145,761, entitled "GOLF CLUB," filed Dec. 31, 2014, all of which are incorporated by reference herein in their entirety.

Figure 2:
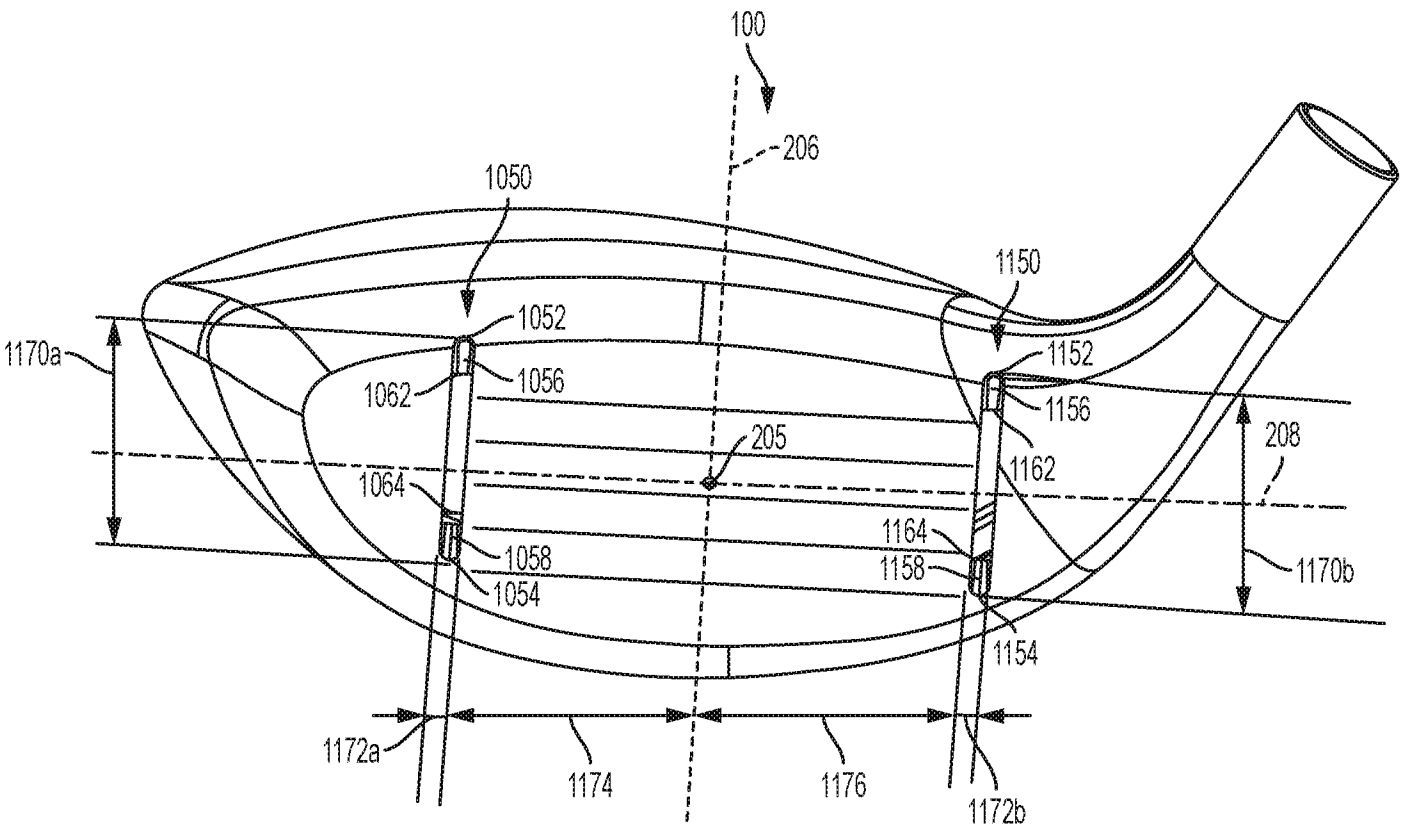
FIG. 2 is a close-up face side view of the golf club head of FIG. 1A

With reference to FIG. 2, each BCF 1050,1150 includes a vertical extent 1170*a,b*. In the current embodiment, each BCF 1050,1150 is about 22.0 mm in vertical extent. In various embodiments, each BCF 1050,1150 may be of a vertical extent between 21-23 mm. In various embodiments, each BCF 1050,1150 may be of a vertical extent between 19.5-24.5 mm. In various embodiments, each BCF 1050, 1150 may be of a vertical extent between 15 and 25 mm. In various embodiments, each BCF 1050,1150 may be of a vertical of at least 10 mm. In various embodiments, each BCF 1050,1150 may be of a vertical extent of up to 35 mm. Although each BCF 1050,1150 is shown in the current embodiment to be of about the same vertical extent 1170*a,b*, in various embodiments the vertical extents may be different. In various embodiments, one BCF 1050,1150 may be omitted, leaving only a single BCF in the face 110. In various embodiments, multiple BCFs may be included in addition to the BCFs 1050,1150. In various embodiments, the BCFs may be of different arrangements, thicknesses, and dimensions.

In the current embodiment, each BCF 1050, 1150 includes a width 1172*a,b*. As annotated, the vertical extent 1170*a,b* is measured parallel to the z-axis 206 and the thickness 1172*a,b* is measured parallel to the x-axis 208. As shown, an innermost end of the BCF 1050 is measured a distance 1174 from the CF 205. An innermost end of the BCF 1150 is measured a distance 1176 from the CF 205. In the current embodiment, the distance 1174 is about 23 mm and the distance 1176 is about 27 mm. In various embodiments, the distances 1174,1176 may be equal to each other. In various embodiments, the distances 1174, 1176 may each be 22-27 mm. In various embodiments, the distances 1174,1176 may each be 20-30 mm. In various embodiments, the distances 1174,1176 may each be 15-40 mm. In various embodiments, the distance 1174 may be larger than 1176, and in various embodiments, the distance 1176 may be larger than the distance 1174. In various embodiments, the thicknesses 1172*a,b* may be as little as 0.5 mm and as large as 10 mm. In various embodiments, the thicknesses 1172*a,b* may be different from each other or may be the same. In various embodiments, the thicknesses 1172*a,b* may be 1-3 mm. in various embodiments, the thicknesses 1172*a,b* may be 0.5-2.5 mm. in various embodiments, the thicknesses 1172*a,b* may be 1.5-2.5 mm. Although the BCFs 1050,1150 are shown being about parallel, in various embodiments the BCFs may be arranged at angular arrangements with respect to the reference coordinate system 200. In the current embodiment, the BCF 1050 includes a crownward end 1052 and a soleward end 1054. Similarly, the BCF 1150 includes a crownward end 1152 and a soleward end 1154. Each BCF 1050,1150 includes a recessed portion at each end 1052, 1054,1152,1154. Proximate to the crownward end 1052 is a recessed portion 1056 that is depressed from the surface of the face 110 but is not a thru-slot portion. A similar recessed portion 1058 is proximate the soleward end 1054. Likewise, recessed portions 1156 and 1158 are located on the BCF 1150. Internal ends 1062 and 1064 of the BCF 1050 are seen as the end of the thru-slot portions, and internal ends 1162,1165 of BCF 1150 are seen as ends of the thru-slot portions.

Figure 3:
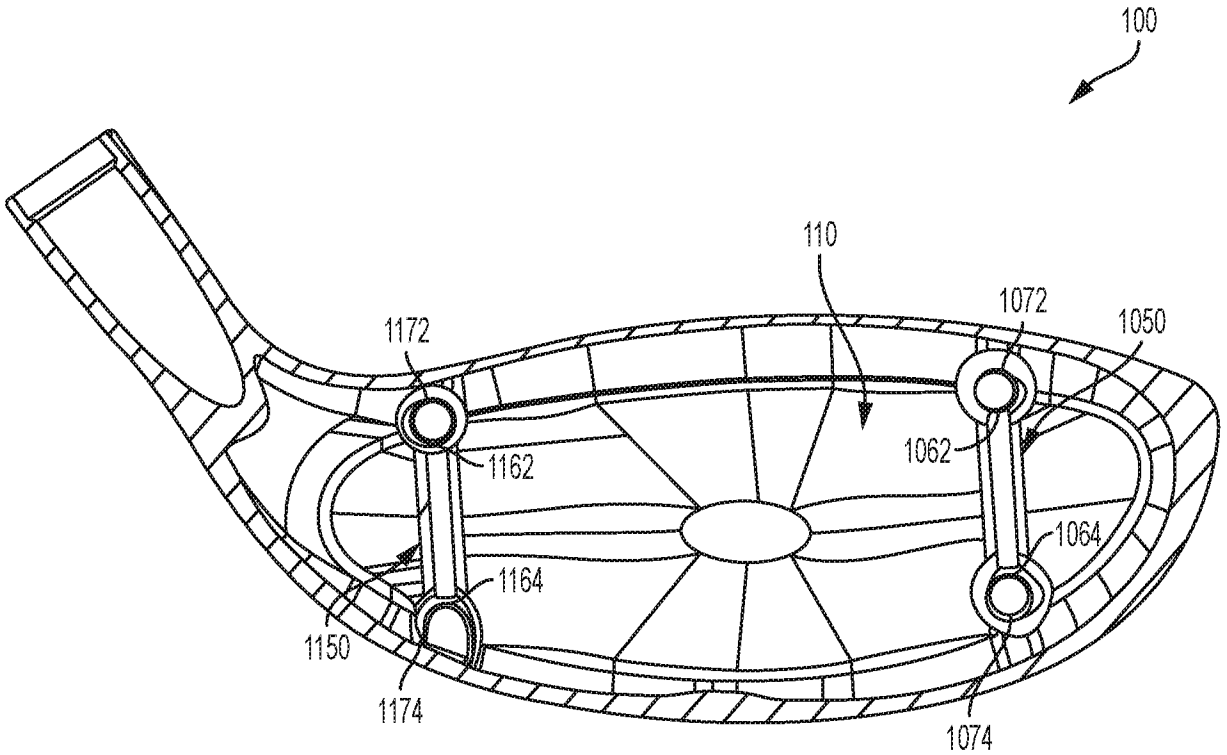
FIG. 3 is a cutaway view of the golf club head of FIG. 1C taken in the plane indicated by line 3-3.

As seen with reference to FIG. 3, the golf club head 100 includes a variable thickness face (VFT), in that the thickness of the face 110 is different at different locations of the face 110. Some variable face thicknesses are described with reference to application for U.S. patent Ser. No. 12/813,442, entitled "GOLF CLUB," filed Jun. 10, 2010, which is incorporated by reference herein in its entirety.

The ends 1052,1054,1152,1154 of the BCFs 1050,1150 are contained within bosses 1072,1074,1172,1174, respectively. The bosses 1072,1074,1172,1174 are thickened regions of the face 110 that encapsulate the ends 1052,1054, 1152,1154 such that stress concentrations in the ends may be adequately addressed to avoid failure of the face 110 and/or cracking. In the current embodiment, the thickened region bosses 1072,1074,1172,1174 are about circular in shape and have a roughly cylindrical arrangement. However, various shapes and configurations may be utilized in various embodiments, including ribs, gradual thickening, mass pads, welding, annealing or other heat treating, or other methods to strengthen the region proximate the BCFs 1050,1150, and, more specifically, proximate the ends 1052,1054,1152, 1154.

Figure 4:
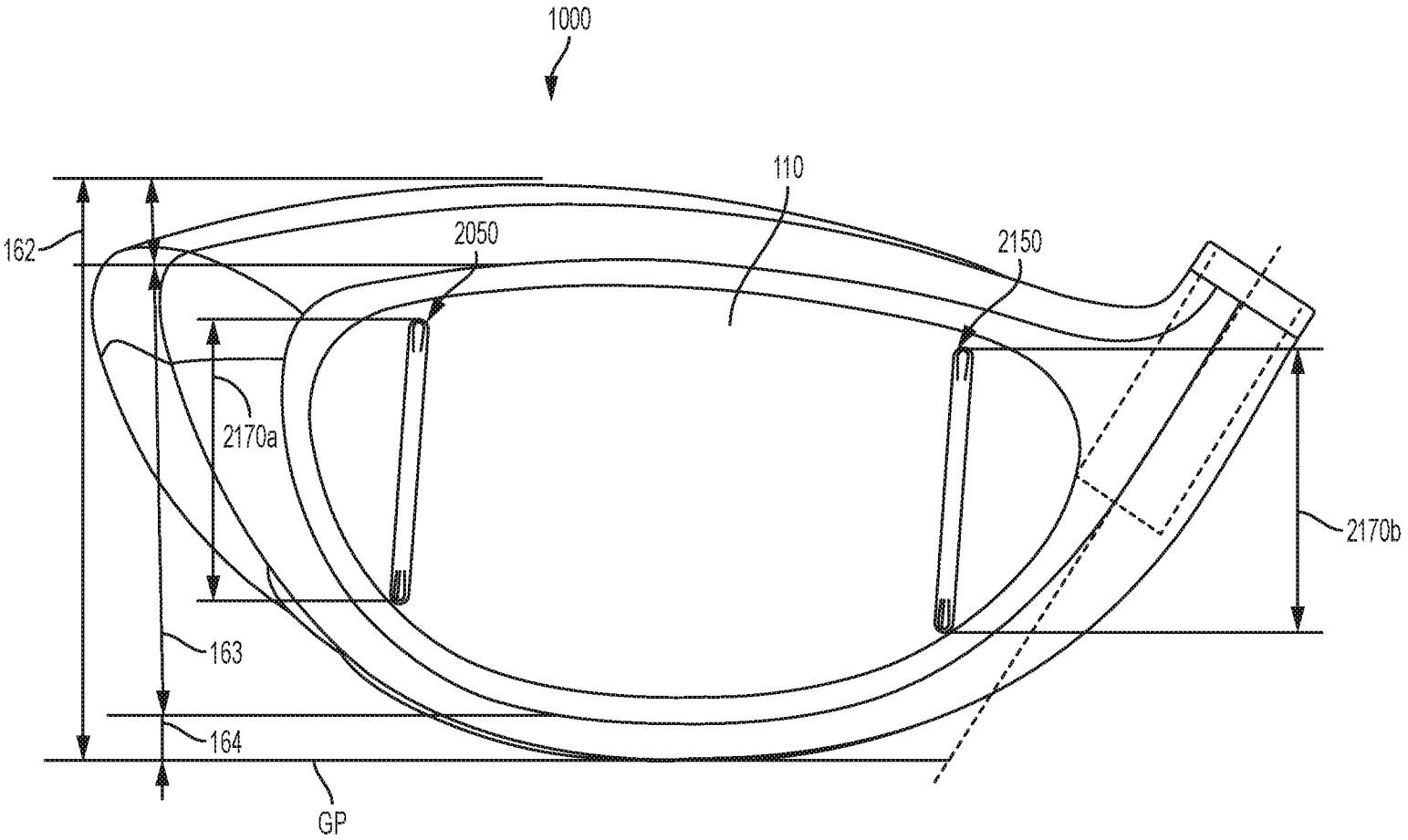
FIG. 4 is a face side view of a golf club head in accord with one embodiment of the current disclosure

With reference to FIG. 4, a golf club head 1000 is shown having various features as discussed elsewhere in this disclosure and in referencing disclosures. It should be noted that dimensions of the golf club head 1000 are generally different from those of golf club head 100. In the current embodiment, the crown height 162 is about 64-65 mm. In various embodiments, the crown height 162 may be 60-70 mm. In various embodiments, the crown height may be 55-75 mm. In various embodiments, the crown height may be 50-80 mm. The golf club head 1000 also has an effective face height 163 of about 46.5 mm. In various embodiments, the effective face height 163 of golf club head 1000 is 45-48 mm. In various embodiments, the effective face height 163 of golf club head 1000 is 40-50 mm. In various embodiments, the effective face height 163 of golf club head 1000 is 35-55 mm. In various embodiments, the effective face height 163 of golf club head 1000 at least 42 mm. In various embodiments, the effective face height 163 may be 2-7 mm less than the crown height 162. In various embodiments, the effective face height 163 may be 2-12 mm less than the crown height 162. In the current embodiment, the effective face position height 164 is about 6.25 mm. In various embodiments, the effective face position height 164 may be 4-8 mm. In various embodiments, the effect face position height 164 may be 0-10 mm. In various embodiments, a composite crown plate may be included. In various embodiments, additional crown features such as composites may be omitted.

As seen with additional reference to FIG. 4, a toe-located BCF 2050 and a heel-located BCF 2150 are located in the face 110 of the golf club head 1000. Although score lines are not shown in the view of FIG. 4, score lines and/or grooves may be included on the face 110 as would be understood by one of ordinary skill in the art. In various embodiments of driver-type golf club heads, score lines may be omitted without material alteration of the playing characteristics of the golf club head, such as in golf club head 1000. Arrangement of the BCFs 2050,2105 is similar to the BCFs 1050, 1150, except that the dimensions of BCFs 2050,2150 are different in absolute terms and in comparison to the size of the face 110 of golf club head 1000 than BCFs 1050,1150. Although the widths 1172*a,b* of the BCFs 2050,2150 may be about the same as the widths 1172*a,b* of the BCFs 1050, 1150, the vertical extents 2170*a,b* of the BCFs 2050,2150 may be different than the vertical extents 1170*a,b* of the BCFs 1050,1150. In the current embodiment, the vertical extents 2170*a,b* are about 35 mm. In various embodiments, the vertical extents 2170*a,b* may be 34-40 mm. In various embodiments, the vertical extents 2170*a,b* may be 30-38 mm. In various embodiments, the vertical extents 2170*a,b* may be 30-42 mm. In various embodiments, the vertical extents 2170*a,b* may be at least 25 mm. In various embodiments, the vertical extents 2170*a,b* may be up to 50 mm. In various embodiments, the vertical extents 2170*a,b* may be 50.8 mm.

Ball speed at a given impact location is directly related to the COR value at that point. Increasing the COR value for off-center impacts therefore increases the resulting ball speed at these locations.

Figure 5A:
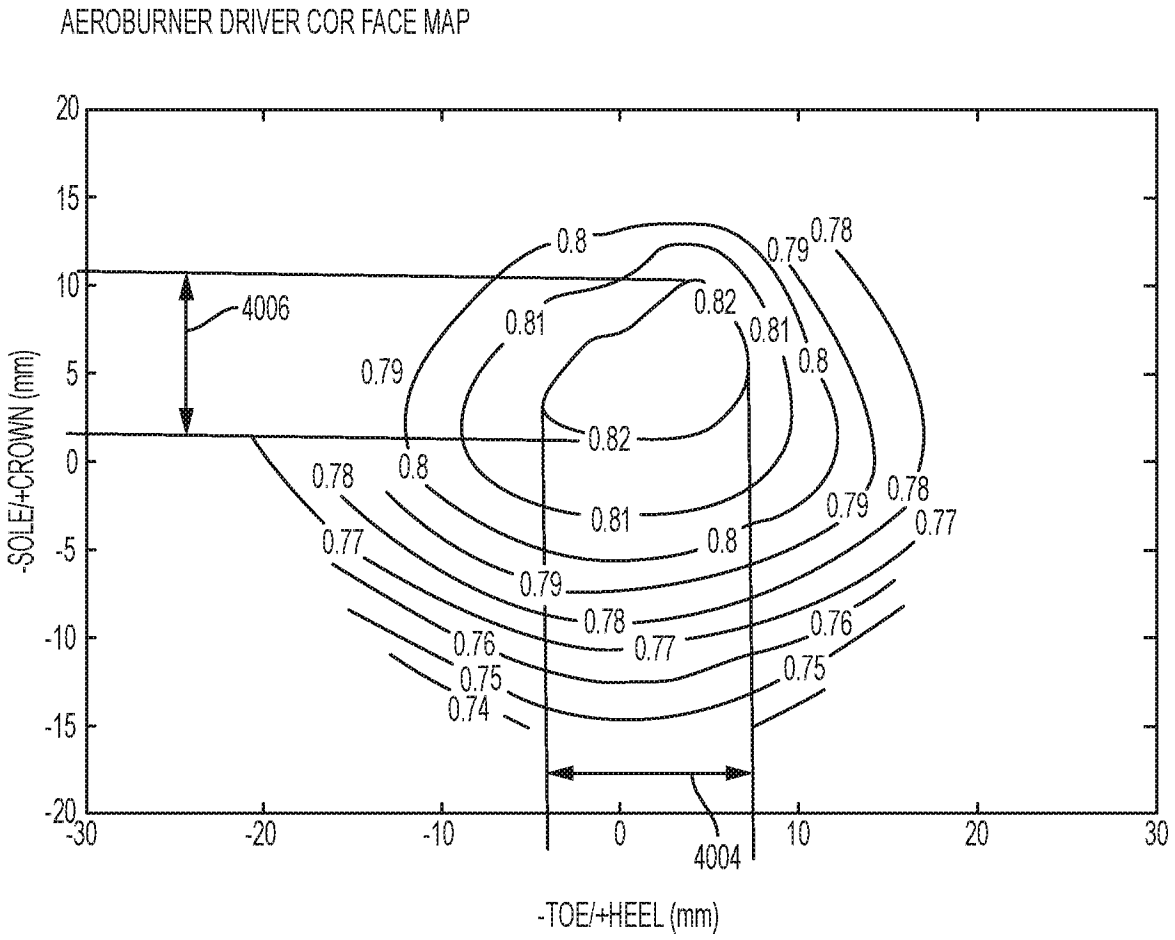
FIG. 5A is a chart showing COR at various locations of the face of a golf club head in accord with one embodiment of the current disclosure.
Figure 5B:
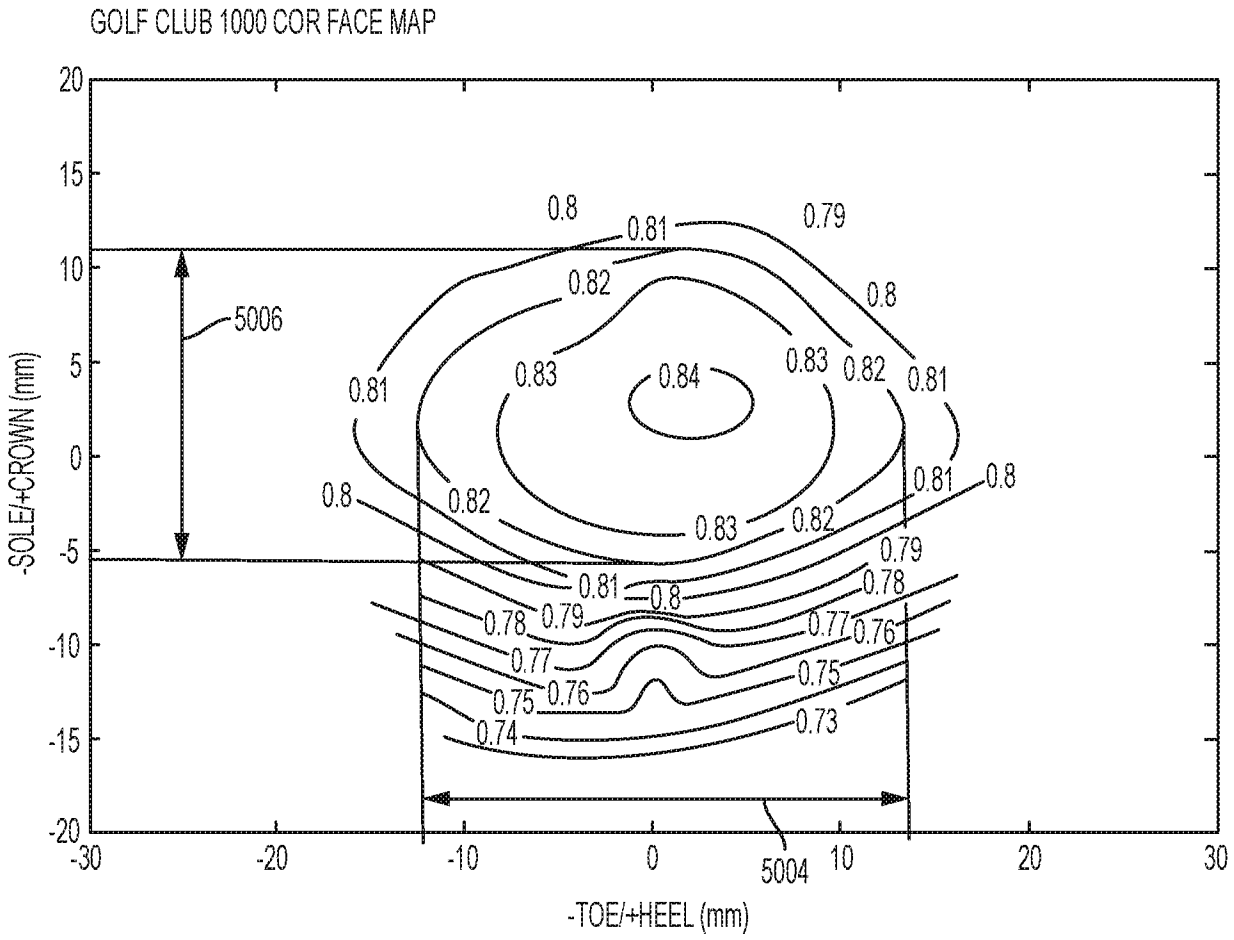
FIG. 5B is a chart showing COR at various locations of the face of a golf club head in accord with one embodiment of the current disclosure.
Figure 5C:
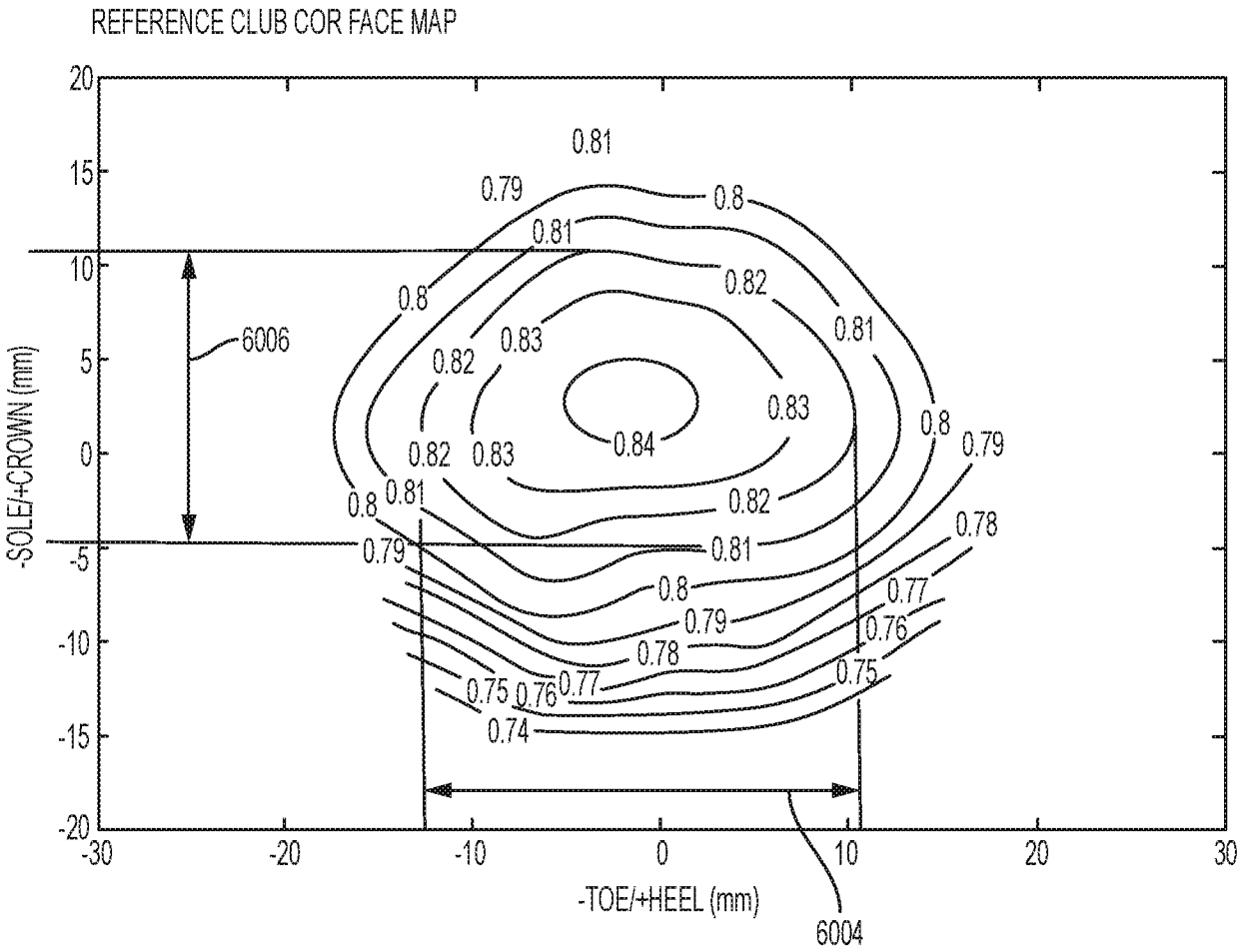
FIG. 5C is a chart showing COR at various locations of the face of a golf club head in accord with one embodiment of the current disclosure.

Data regarding COR of the various golf club heads is aggregated with reference to FIGS. 5A-5C. For any area of the face 110, golf club head 1000 tends to have higher COR as compared to the AeroBurner reference club and as compared to a golf club head 1000 without BCFs 2050,2150. Each band of FIGS. 5A-5C represents the approximate margin of the COR annotated. For example, for all area inside a band annotated as "0.8," the COR of the golf club head is at least 0.800. Understanding the size of each COR band aids in understanding the area of the golf club face that is above a certain COR.

However, the shapes of the COR bands are not perfectly circular. Although COR area can likely be calculated by interpolation software, an exact measure of the face area above a certain COR may be difficult to accomplish. As such, an approximation of COR area can be taken.

In order to determine an approximation of the COR area for any band, a first extent of the band is taken parallel to the z-axis, and a second extent of the band is taken parallel to the x-axis. The first extent and second extent are maximum dimensions of the shape for which the COR is at least the required number. From each of the first extent and the second extent, a circle is made using each extent as a diameter. The area of each circle is calculated, and an average of the areas of the two circles provides an approximation of the area within the band, also known as an equivalent area and represented as $Area_{Equivalent}$. Formulas representing the procedure above are provided below. For the sake of the formulas, the first extent is annotated as $Z_{Extent}$ and the second extent is annotated as $X_{Extent}$.

$$Area_{Equivalent} = \frac{Area_{Z-Extent} + Area_{X-Extent}}{2} \text{ wherein}$$

$$Area_{Z-Extent} = \pi\left(\frac{z_{Extent}}{2}\right)^2$$

-continued $$Area_{X-Extent} = \pi\left(\frac{x_{Extent}}{2}\right)^2$$

As seen with particular reference to FIG. 5A, a first extent 4004 and a second extent 4006 are seen for the COR having a value of at least 0.820. For the embodiment of the AeroBurner reference club, the first extent 4004 is about 11.25 mm and the second extent 4006 is about 8.75 mm for a COR of at least 0.820. The circular area relative to the first extent 4004 is about 99.4 $mm^2$ and the circular area relative to the second extent 4006 is about 60.1 $mm^2$. An average of the two areas representing an equivalent area is about $Area_{Equivalent}$=79.8 $mm^2$. Because such numbers are approximations, it is understood that a difference of up to 5% is within reasonable error of the measurement and calculation methodology. Similarly, if actual COR area is known, it will be understood that a calculation error of up to 10% is reasonable given the error of the measurements and calculation methodology.

With reference to FIG. 5B—which represents golf club head 1000—a first extent 5004 of an area for which the COR is at least 0.820 is about 25.0 mm and a second extent 5006 is about 15.7 mm. The circular area relative to the first extent 5004 is about 490.9 $mm^2$ and the circular area relative to the second extent 5006 is about 193.6 $mm^2$. As such, an average of the two areas representing an equivalent area is about $Area_{Equivalent}$=342.3 $mm^2$.

Similarly, with reference to FIG. 5C—which represents a golf club head similar to golf club head 1000 but without BCFs 2050 and 2150—a first extent 6004 of an area for which the COR is at least 0.820 is about 23.1 mm and a second extent 6006 is about 15.0 mm. The circular area relative to the first extent 6004 is about 419.1 $mm^2$ and the circular area relative to the second extent 6006 is about 176.7 $mm^2$. As such, an average of the two areas representing an equivalent area is about $Area_{Equivalent}$=297.9 $mm^2$. It should be noted that the golf club of FIG. 5C includes boundary condition features at the junction between the face 110 and the golf club body such that the boundary conditions are more flexible than those of the AeroBurner reference club of FIG. 5A. These features do provide a benefit over the AeroBurner reference club of FIG. 5A, but these features are comparably less effective than the BCFs 2050,2150, as seen with reference to the equivalent areas of various COR ranges.

With respect to the various measurements, Table 1 reproduces data of the interpolation charts for the first and second extents of each COR for each club, as shown.

TABLE 1

| | AeroBurner Ref (FIG. 5A) | | | Golf Club 1000 (FIG. 5B) | | | Golf Club w/o Face Slots (FIG. 5C) | | |
|---|---|---|---|---|---|---|---|---|---|
| COR | $Z_{Extent}$ | $X_{Extent}$ | $A_{Equivalent}$ | $Z_{Extent}$ | $X_{Extent}$ | $A_{Equivalent}$ | $Z_{Extent}$ | $X_{Extent}$ | $A_{Equivalent}$ |
| 0.840 | 0 | 0 | 0 | 3.13 | 6.56 | 20.7 | 4.38 | 6.88 | 26.1 |
| 0.830 | 0 | 0 | 0 | 13.8 | 18.1 | 203.3 | 10.3 | 16.9 | 153.6 |
| 0.820 | 11.3 | 8.75 | 79.8 | 15.7 | 25.0 | 342.2 | 15.0 | 23.1 | 297.9 |
| 0.810 | 15.0 | 18.1 | 217.4 | 19.4 | 31.9 | 546.4 | 19.4 | 28.1 | 458.0 |
| 0.800 | 18.8 | 23.8 | 359.6 | ND | ND | ND | 22.5 | 33.8 | 646.1 |
| 0.790 | 21.9 | 28.8 | 512.5 | ND | ND | ND | ND | ND | ND |

For Table 1, data points indicated with "ND" are meant to indicate that no data is collected for the data point. For the AeroBurner reference club, "0" is included wherein no area exists wherein the COR is above 0.820 as tested. As can be seen by comparing the reference club of FIG. 5C with golf club head 1000 of FIG. 5B, the $Z_{Extent}$ is not tremendously different between the clubs for certain ranges. For example, at COR of 0.810, the $Z_{Extent}$ of 19.4 mm is the same between the reference club and golf club head 1000, but the $X_{Extent}$ is larger for golf club head 1000. As such, the benefit of BCFs 2050,2150 can be easily seen.

In testing, one methodology involves first finding the balance point of the club. Following such a determination, additional impact points that are coaxial with the balance point can be used as measured parallel to the x-axis and parallel to the z-axis. Tests may be performed along each of these axes to determine most closely the extent of a range having the desired COR. When the desired COR is determined in the ±x-axis and ±z-axis directions, these values may be substituted for the $Z_{Extent}$ and $X_{Extent}$ values to determine $A_{Equivalent}$. In many embodiments, the determined value will be within 10% measurement and calculation error of the actual value.

Although data is quantified for driver-type golf club heads, similar—and, in some cases, better—performance gains are seen in fairway wood-type golf club heads.

Figure 6:
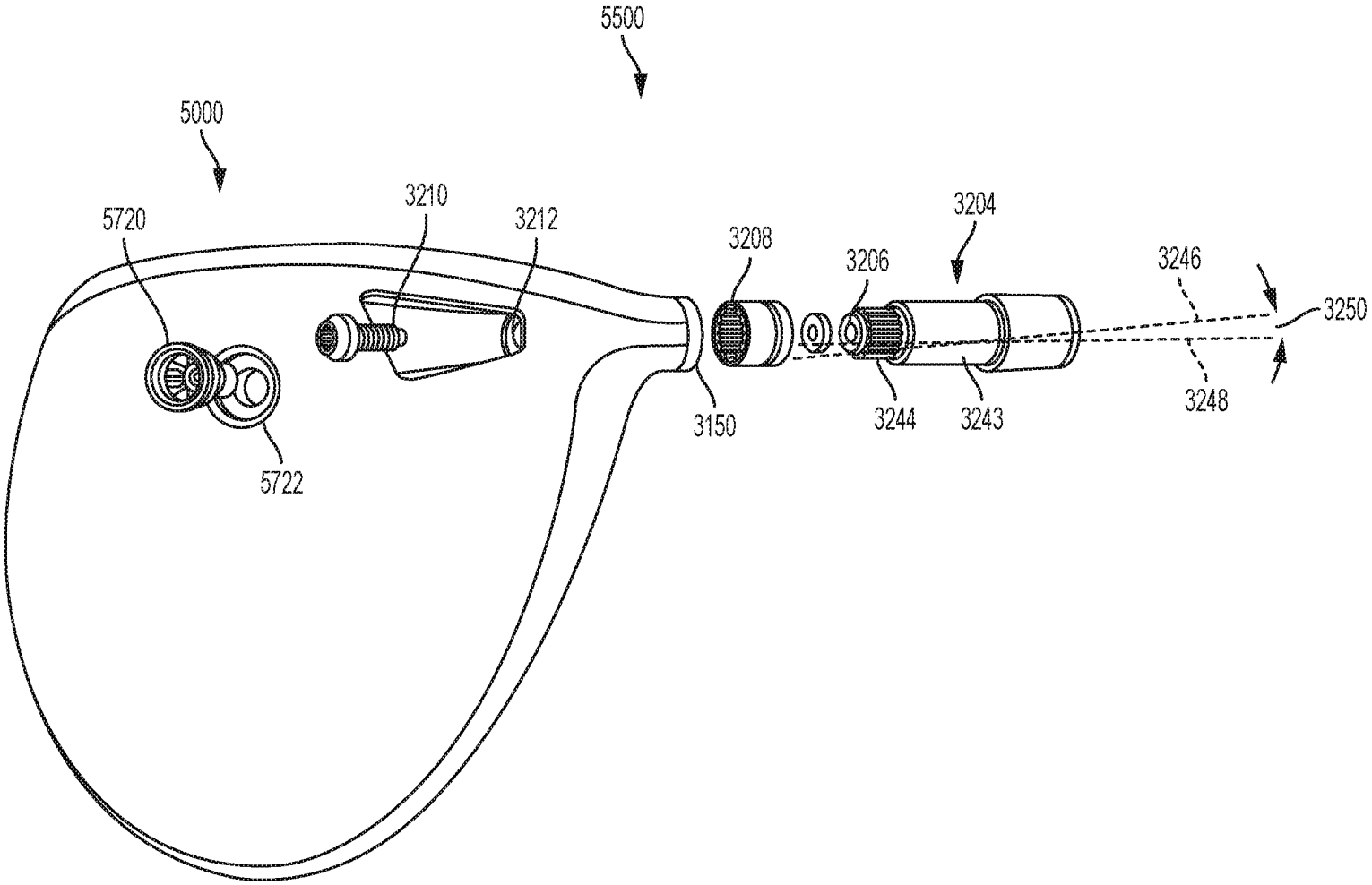
FIG. 6 is a perspective view of a golf club assembly in accord with one embodiment of the current disclosure.

The embodiment shown in FIG. 6 includes an adjustable loft, lie, or face angle system that is capable of adjusting the loft, lie, or face angle either in combination with one another or independently from one another as described in detail in U.S. Pat. No. 7,887,431, entitled "GOLF CLUB," filed Dec. 30, 2008, which is incorporated by reference herein it its entirety. A shaft (not shown) is inserted into the sleeve bore and is mechanically secured or bonded to the sleeve 3204 for assembly into a golf club using a golf club head 5000, which may be a golf club head of the current disclosure (golf club head 100 or golf club head 1000). The sleeve 3204 further includes an anti-rotation portion 3244 at a distal tip of the sleeve 3204 and a threaded bore 3206 for engagement with a screw 3210 that is inserted into a sole opening 3212 defined in the golf club head 5000. The anti-rotation portion 3244 of the sleeve 3204 engages with an anti-rotation collar 3208 which is bonded or welded within a hosel 3150 of the golf club head 5000. Although not shown, the shaft and a grip may be included as part of a golf club assembly 5500 that includes the golf club head 5000 and the adjustable loft, lie, or face angle system. A first portion 3243 of the sleeve 3204, the sleeve bore 3242, and the shaft collectively define a longitudinal axis 3246 of the assembly. The sleeve 3204 is effective to support the shaft along the longitudinal axis 3246, which is offset from a longitudinal axis 3248 of the hosel 3150 by offset angle 3250. The longitudinal axis 3248 is intended to align with the SA (seen in FIG. 1B, for example). The sleeve 3204 can provide a single offset angle 3250 that can be between 0 degrees and 4 degrees, in 0.25 degree increments. For example, the offset angle can be 1.0 degree, 1.25 degrees, 1.5 degrees, 1.75 degrees, 2.0 degrees or 2.25 degrees. The sleeve 3204 can be rotated to provide various adjustments to the golf club assembly 5500. In various embodiments, the sleeve 3204 may be mechanically fastenable to the golf club head 5000 to secure the shaft in a variety of positions relative to the golf club head 5000, thereby altering at least one of the loft angle, lie angle, and face angle of the golf club assembly 5500. In various embodiments, the sleeve 3204 may be secured to the hosel or to another portion of the golf club head 5000 depending on arrangement. One of skill in the art would understand that using mechanical methods would be considered fastening to the hosel. In various embodiments, mechanical fastening may include, a variety of connection mechanisms, including screws, various threading arrangements, velcros and similar systems, and the use of glues and various other permanent fastening methods, among others. One of skill in the art would understand that the system described with respect to the current golf club assembly 5500 can be implemented the various embodiments of golf club heads (100, 1000) of the current disclosure.

Because the BCFs of the current embodiment include through-slot embodiments (providing a void in the golf club body), it is advantageous to fill the BCFs with a plugging material to prevent introduction of debris and to provide separation between the interior and the exterior of the various golf club heads of the various embodiments. The plugging materials disclosed in application for U.S. patent Ser. No. 13/839,727 are generally suitable for BCFs of the current embodiments and are incorporated herein by reference.

As can be seen, the golf club head 5000 may include at least one weight 5720 that may be attachable to and removable from the golf club head 5000 in various embodiments. In various embodiments, the weight 5720 may be omitted. In various embodiments, multiple moveable weights may be included. The weight 5720 of the current embodiment is configured to be secured within a weight port 5722. In various embodiments, discretionary mass may be moveable using various methods, including those described in U.S. Pat. No. 7,166,040, entitled "REMOVABLE WEIGHT AND KIT FOR GOLF CLUB HEAD," filed Feb. 23, 2004, and U.S. Pat. No. 6,773,360, entitled "GOLF CLUB HEAD HAVING A REMOVABLE WEIGHT," filed Nov. 8, 2002, which are incorporated by reference herein in their entirety.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

We claim:

1. A golf club head comprising:

a golf club body, the golf club body including a crown, a sole, and a skirt connecting the crown to the sole, the golf club body including a heel portion and a toe portion; and a striking face connected to a front of the golf club body, the striking face including:

an inner surface and an outer surface defining a thickness, the thickness being measured as the distance between the inner surface and the outer surface;

a toe-located boundary condition feature;

a heel-located boundary condition feature; and at least one variation in thickness formed by a boss that is proximate to at least one end of the toe-located boundary condition feature or the heel-located boundary condition feature, wherein the toe-located boundary condition feature and the heel-located boundary condition feature are elongated thru-slots, the boss encapsulates the at least one end of at least one of the thru-slots in order to reduce at least one stress concentration, and wherein there are no thru-slots between the toe-located boundary condition feature and the heel-located boundary condition feature.

2. The golf club head of claim 1, wherein the at least one variation in thickness is an increase in thickness relative to at least one portion of the striking face that is distal to the end.

3. The golf club head of claim 2, further comprising a shaft connection system, the shaft connection system allowing adjustment of at least one of loft angle, lie angle, and face angle of the golf club head.

4. The golf club head of claim 1, wherein the thru-slots have a length of about 10 to 50 mm.

5. The golf club head of claim 1, wherein the boss is about cylindrical.

6. The golf club head of claim 1, wherein the toe-located boundary condition feature and the heel-located boundary condition feature are elongated in a direction from crown-to-sole.

7. The golf club head of claim 6, further comprising a shaft connection system, the shaft connection system allowing adjustment of at least one of loft angle, lie angle, and face angle of the golf club head.

8. The golf club head of claim 6, wherein the heel-located boundary condition and toe-located boundary condition are each elongated in a z-direction.

9. The golf club head of claim 1, further comprising a shaft connection system, the shaft connection system allowing adjustment of at least one of loft angle, lie angle, and face angle of the golf club head.

10. The golf club head of claim 1 wherein the toe-located boundary condition feature and heel-located boundary condition feature are each elongated in a z-direction.

11. The golf club head of claim 1, wherein the thru-slots have a length of about 10 to 50 mm.

12. The golf club of claim 1, wherein the golf club head further comprises a first extent that extends parallel to the z-axis and a second extent that extends parallel to the x-axis, the first extent and the second extent being defined by a region of COR having a value of at least 0.820.

13. The golf club of claim 12, wherein the golf club head further comprises an $Area_{Z\text{-}Extent}$ associated with the first extent and an $Area_{X\text{-}Extent}$ associated with the second extent.

14. The golf club of claim 12 wherein the thru-slots each have a vertical extent of about 15 to 25 mm.

15. The golf club of claim 12 wherein the thru-slots have a width of about 1 to 3 mm.

* * * * *